US011247097B2

(12) United States Patent
Chen

(10) Patent No.: US 11,247,097 B2
(45) Date of Patent: Feb. 15, 2022

(54) ELLIPTICAL MACHINE CAPABLE OF REALIZING THREE-DIMENSIONAL PEDALING TRAINING

(71) Applicant: CHANG YOW TECHNOLOGIES INTERNATIONAL CO., LTD., Taichung (TW)

(72) Inventor: Chao-Chuan Chen, Taichung (TW)

(73) Assignee: CHANG YOW TECHNOLOGIES INTERNATIONAL CO., LTD., Taichung (TW)

( * ) Notice: Subject to any disclaimer, the term of this patent is extended or adjusted under 35 U.S.C. 154(b) by 278 days.

(21) Appl. No.: 16/662,481

(22) Filed: Oct. 24, 2019

(65) Prior Publication Data

US 2021/0069545 A1 Mar. 11, 2021

(30) Foreign Application Priority Data

Sep. 10, 2019 (TW) ..... 108132650

(51) Int. Cl.
*A63B 22/06* (2006.01)
*A63B 21/00* (2006.01)
(Continued)

(52) U.S. Cl.
CPC ..... *A63B 22/0664* (2013.01); *A63B 21/0058* (2013.01); *A63B 21/225* (2013.01);
(Continued)

(58) Field of Classification Search
CPC ... A63B 21/00; A63B 21/004; A63B 21/0047; A63B 21/02; A63B 21/0023; A63B 21/00054; A63B 21/00058; A63B 21/00061; A63B 21/00065; A63B 21/00072; A63B 21/00076; A63B 21/000178; A63B 21/00181; A63B 21/00185; A63B 21/00189; A63B 21/00192; A63B 21/00196; A63B 21/002;
(Continued)

(56) References Cited

U.S. PATENT DOCUMENTS 6,027,430 A * 2/2000 Stearns ..... A63B 21/068 482/51
6,949,054 B1 * 9/2005 Stearns ..... A63B 22/001 482/52

(Continued)

*Primary Examiner* — Megan Anderson
*Assistant Examiner* — Thao N Do
(74) *Attorney, Agent, or Firm* — Muncy, Geissler, Olds & Lowe, P.C.

(57) ABSTRACT

An elliptical machine includes a machine frame and two pedal units each including a vertical arm having a top end pivotally connected to the machine frame and swingable back and forth, a driving main arm having a front end arranged on an opposing bottom end of the vertical arm in a vertically swingable manner, a pedal mount arranged on an opposing rear end of the driving main arm and swingable left and right, a pedal arranged on the pedal mount and swingable left and right, a slanting rod having a front end arranged on the vertical arm in a vertically swingable manner and an opposing rear end arranged on the pedal mount in a universally rotatable manner, and a rocking link that has a front end arranged on the rear end of the driving main arm and swingable back and forth and up and down.

8 Claims, 12 Drawing Sheets

(51) Int. Cl.
*A63B 22/00* (2006.01)
*A63B 24/00* (2006.01)
*A63B 21/22* (2006.01)
*A63B 21/005* (2006.01)

(52) U.S. Cl.
CPC ..... *A63B 21/4034* (2015.10); *A63B 21/4035* (2015.10); *A63B 22/001* (2013.01); *A63B 22/0064* (2013.01); *A63B 24/0087* (2013.01)

(58) Field of Classification Search
CPC ..... A63B 21/005; A63B 21/0055; A63B 21/0058; A63B 21/0059; A63B 21/008; A63B 21/0083; A63B 21/0087; A63B 21/0085; A63B 21/0088; A63B 21/012; A63B 21/026; A63B 21/027; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/078; A63B 21/08; A63B 21/15; A63B 21/151; A63B 21/158; A63B 21/159; A63B 21/16; A63B 21/1627; A63B 21/1681; A63B 21/22; A63B 21/222; A63B 21/225; A63B 21/227; A63B 22/0002; A63B 22/0005; A63B 22/0007; A63B 22/001; A63B 22/0012; A63B 22/0015; A63B 22/0017; A63B 22/0046; A63B 22/0048; A63B 22/0056; A63B 22/0058; A63B 22/0061; A63B 22/14; A63B 22/0064; A63B 22/0066; A63B 22/0069; A63B 22/0084; A63B 22/0087; A63B 22/0089; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04; A63B 22/06; A63B 22/0605; A63B 22/0664; A63B 22/16; A63B 22/18; A63B 22/20; A63B 22/201; A63B 22/203; A63B 22/205; A63B 22/208; A63B 2022/0028; A63B 2022/003; A63B 2022/0033; A63B 2022/0035; A63B 2022/0038; A63B 2022/0041; A63B 2022/0043; A63B 2022/0051; A63B 2022/0053; A63B 2022/0071; A63B 2022/0074; A63B 2022/0092; A63B 2022/0094; A63B 2022/0271; A63B 2022/0278; A63B 2022/0611; A63B 2022/0617; A63B 2022/0623; A63B 2022/206; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 2022/185; A63B 23/0458; A63B 23/0464; A63B 23/12; A63B 23/00; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/03583; A63B 23/03591; A63B 23/04; A63B 23/0405; A63B 23/047; A63B 23/0476; A63B 23/0482; A63B 23/0488; A63B 23/0494; A63B 23/08; A63B 23/0855; A63B 23/10; A63B 23/1254; A63B 23/1263; A63B 23/1272; A63B 23/1281; A63B 23/16; A63B 23/18; A63B 2023/003; A63B 2023/006; A63B 2023/0205; A63B 2023/02; A63B 2023/0211; A63B 2023/0216; A63B 2023/0222; A63B 2023/0227; A63B 2023/0233; A63B 2023/0417; A63B 2023/0429; A63B 2023/0447; A63B 2023/0452; A63B 24/00; A63B 24/0003; A63B 24/0006; A63B 24/0087; A63B 2024/0009; A63B 2024/0012; A63B 2024/0015; A63B 2024/0018; A63B 69/00; A63B 69/0022; A63B 69/0028; A63B 69/0057; A63B 69/0062; A63B 69/18; A63B 69/182; A63B 2069/0031; A63B 2069/0033; A63B 2071/0063; A63B 2071/0072; A63B 2208/00; A63B 2208/02; A63B 2208/0204; A63B 2208/0209
USPC ..... 482/51
See application file for complete search history.

(56) References Cited

U.S. PATENT DOCUMENTS

| | | | | |
|---|---|---|---|---|
| 7,591,761 | B1 * | 9/2009 | Ellis | A63B 21/22 482/52 |
| 9,636,541 | B1 * | 5/2017 | Hsu | A63B 23/03525 |
| 9,873,014 | B1 * | 1/2018 | Kuo | A63B 22/0015 |
| 9,925,412 | B1 * | 3/2018 | Lu | A63B 22/0664 |
| 2007/0054779 | A1 * | 3/2007 | Lee | A63B 22/0664 482/52 |
| 2008/0032867 | A1 * | 2/2008 | Liao | A63B 22/0664 482/52 |
| 2008/0125291 | A1 * | 5/2008 | Watt | A63B 22/001 482/52 |
| 2009/0209394 | A1 * | 8/2009 | Kwon | A63B 22/001 482/52 |
| 2009/0291810 | A1 * | 11/2009 | Kwon | A63B 22/001 482/52 |
| 2010/0151999 | A1 * | 6/2010 | Kuo | A63B 22/205 482/52 |
| 2012/0172176 | A1 * | 7/2012 | Zhang | A63B 22/0046 482/8 |
| 2015/0182787 | A1 * | 7/2015 | Liu | A63B 22/001 482/52 |
| 2015/0238809 | A1 * | 8/2015 | Huang | A63B 22/001 482/57 |
| 2016/0089562 | A1 * | 3/2016 | Grossmann | A63B 22/0664 482/52 |
| 2016/0263427 | A1 * | 9/2016 | Mueller | A63B 24/0087 |
| 2017/0189743 | A1 * | 7/2017 | Smith | A63B 21/023 |
| 2018/0185691 | A1 * | 7/2018 | Smith | A63B 22/0664 |
| 2018/0185698 | A1 * | 7/2018 | Anderson | A63B 21/154 |
| 2021/0178222 | A1 * | 6/2021 | Lo | A63B 22/201 |

* cited by examiner

ELLIPTICAL MACHINE CAPABLE OF REALIZING THREE-DIMENSIONAL PEDALING TRAINING

BACKGROUND OF THE INVENTION

1. Field of the Invention

The present invention relates to elliptical machine technology and more particularly, to an elliptical machine that can realize three-dimensional pedaling training.

2. Description of the Related Art

An elliptical machine is a kind of cardio-pulmonary training equipment developed in recent years. It mainly allows the user to step on the left and right pedals to move along an approximately elliptical trajectory to achieve simulated walking, running or stair climbing. Since the trajectory of the pedals of conventional elliptical machines is mostly fixed, the whole process will be tedious, and the leg muscles of other parts will not be trained.

SUMMARY OF THE INVENTION

The present invention has been accomplished under the circumstances in view. It is the main object of the present invention to provide an elliptical machine, which can realize three-dimensional pedaling training.

To achieve this and other objects of the present invention, an elliptical machine in accordance with the present invention comprises a machine frame, two pedal units, two handlebars, and a flywheel set. Each pedal unit comprises a vertical arm, a driving main arm, a pedal mount, a slanting rod, a pedal and a rocking link. The vertical arm has a top end thereof pivotally connected to the machine frame and swingable back and forth relative to the machine frame. The driving main arm has a front end thereof pivotally connected to a bottom side of the vertical arm and swingable up and down relative to the machine frame. The pedal mount has a front end thereof pivotally connected to an opposing rear end of the driving main arm and swingable left and right relative to the driving main arm. The pedal is pivoted to an opposing rear end of the pedal mount and swingable left and right relative to the pedal mount. The slanting rod has a front end thereof pivotally connected to the vertical arm in a vertically swingable manner and located above the front end of the driving main arm, and an opposing rear end thereof pivotally connected to the front end of the pedal mount in a universally rotatable manner. The rocking link has a front end thereof pivotally connected to the rear end of the driving main arm and swingable back and forth and up and down relative to the driving main arm, and an opposing rear end thereof pivotally connected to the pedal in a universally rotatable manner. The two handlebars are located on opposing left and right sides of the machine frame, each having a bottom end thereof respectively pivotally connected to the center of the respective driving main arms and swingable back and forth relative to the respective driving main arms. The flywheel set comprises two flywheels and two crankshafts. The two flywheels are respectively pivotally mounted on the left and right sides of the machine frame in a rotatable manner. The crankshafts have respective one ends thereof respectively connected to the flywheels and respective opposite ends thereof respectively connected to the driving main arms so that the crankshafts can be driven by the driving main arms to rotate the flywheels.

It can be seen from the above that the elliptical machine of the present invention utilizes the multi-link design of the two pedal units, so that the user presents a three-dimensional motion mode of swinging left and right along the elliptical trajectory when stepping on the two left and right pedals. Thus, the leg muscles of different parts can be trained, and the whole pedaling process is more interesting and challenging.

Preferably, the elliptical machine further comprises a step length adjustment unit. The step length adjustment unit comprises a motor, a lead screw, an internally-threaded tube and a slide. The motor is mounted on the machine frame. The lead screw has one end thereof connected to the motor. The internally-threaded tube is threaded onto the lead screw and drivable by the lead screw to move along the axial direction of the lead screw. The slide is connected to the internally-threaded tube and the top ends of the vertical arms of the two pedal units so that the slide can be driven by the internally-threaded tube to move the vertical arms of the two pedal units forward or backward. This allows the user to adjust the step length according to actual needs.

Preferably, the step length adjustment unit further comprises two guide rails disposed on opposing left and right sides, and the slide comprises two guide wheels respectively disposed on opposing left and right sides thereof and respectively rotatably mounted in the guide rails to increase the stability and smoothness during the operation.

Preferably, the machine frame comprises a casing. The casing covers the step length adjustment unit, having two position-limiting slots respectively located on opposing left and right sides thereof. Each position-limiting slot is covered by a respective shutter. The extending direction of each position-limiting slot is parallel to the axial direction of the lead screw. The top ends of the two vertical arms are pivotally connected to a front axle. The front axle is located inside the casing and has two opposite ends thereof respectively connected to the two shutters. The slide comprises a transmission tube and two end caps. The transmission tube is coaxially sleeved over the front axle and maintained at a predetermined interval from the front axle. The two end caps are respectively disposed in two opposite ends of the transmission tube and tightly disposed on the front axle so that the slide can carry the two vertical arms to move with the internally-threaded tube. Thereby, the slide uses the transmission tube and the end caps to drive the front axle while moving, and then the front axle drives the two vertical arms to move forward or backward together to achieve the effect of adjusting the step length.

Preferably, each said handlebar comprises an upper tube and a lower tube. The upper tube has a top end thereof configured for grasping by the user's hand, and an opposing bottom end thereof pivotally connected with a top end of the lower tube to the casing of the machine frame in a forward-backward swingable manner. The lower tube has an opposing bottom end thereof pivotally connected to a top end of a hanging tube in a forward-backward swingable manner. The hanging tube has an opposing bottom end thereof pivotally connected to the top end of one driving main arm in a forward-backward swingable manner. In this way, the two handlebars can swing back and forth along with the two driving main arms.

Other advantages and features of the present invention will be fully understood by reference to the following specification in conjunction with the accompanying drawings, in which like reference signs denote like components of structure.

DETAILED DESCRIPTION OF THE INVENTION

Figure 1:
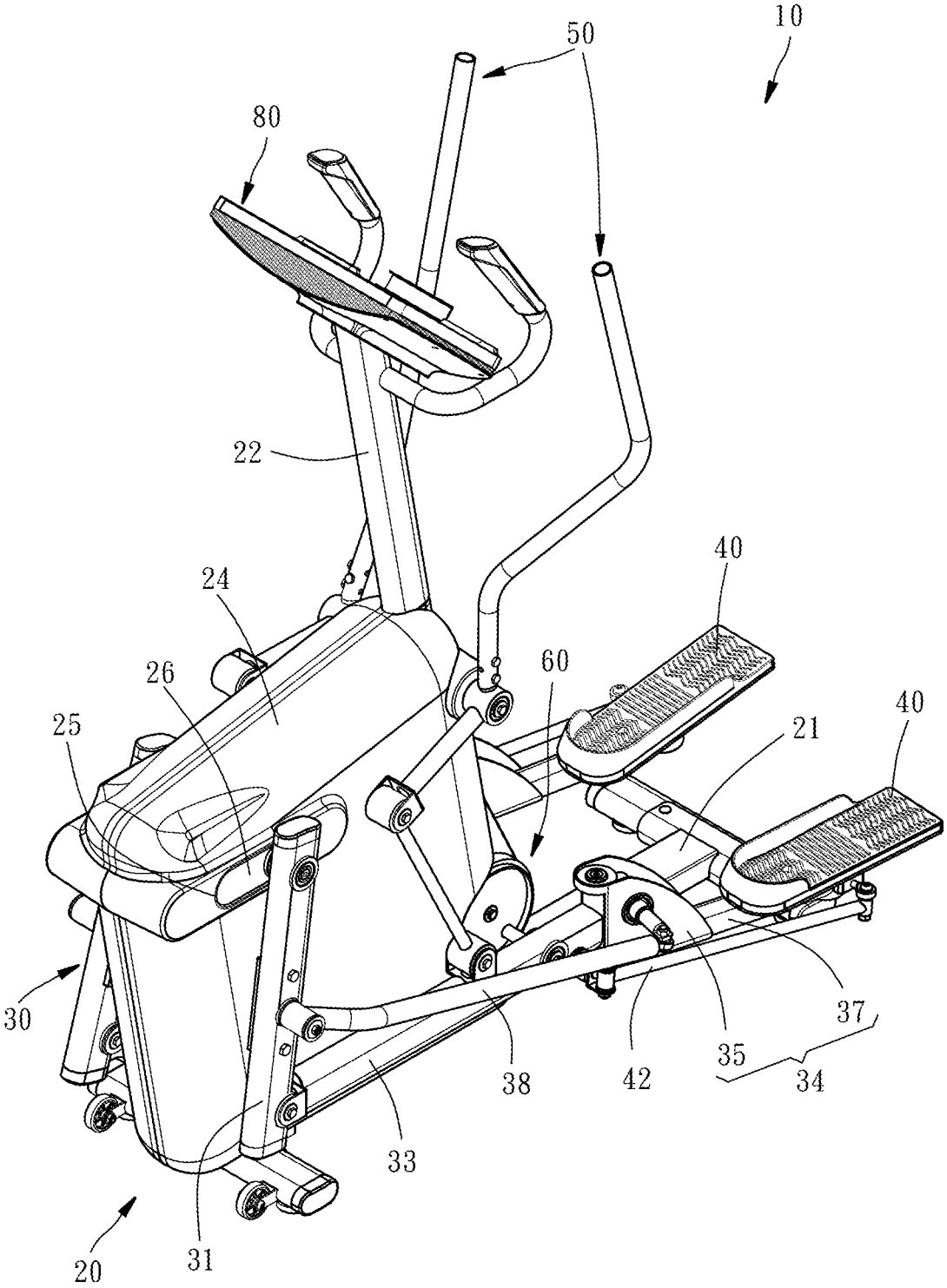
FIG. 1 is an oblique top elevational view of an elliptical machine embodying the present invention.

The applicant first describes here, and in the entire specification, including the embodiment described below and the claims of the patent application, the directional terms are based on the directions in the drawings. Secondly, in the preferred embodiment and the drawings, the same reference numerals are used to refer to the same or similar elements or structural features thereof.

Figure 2:
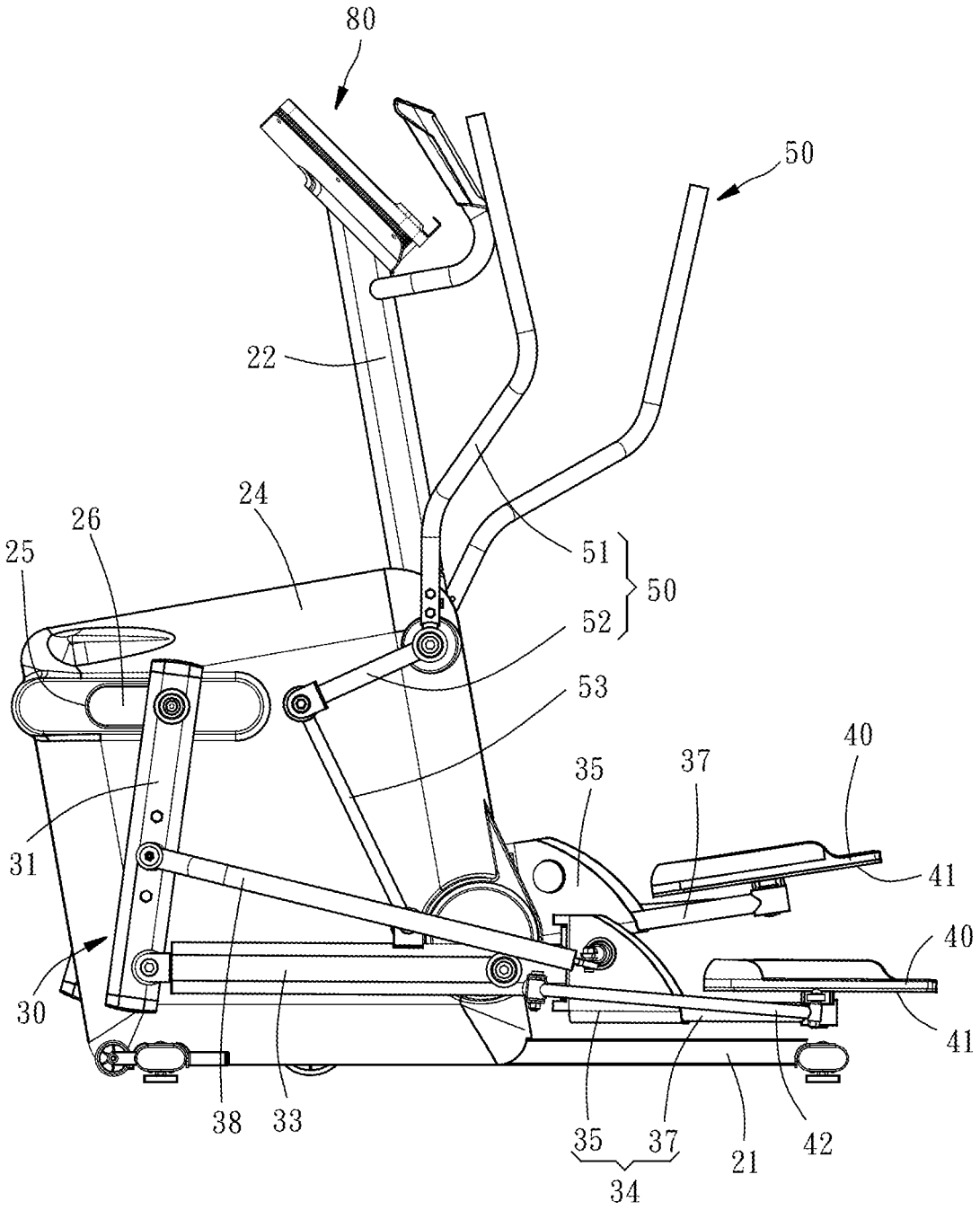
FIG. 2 is a side view of the present invention, showing the pedal units of the elliptical machine in the short step length mode.

Referring to FIGS. 1 and 2, an elliptical machine 10 in accordance with the present invention comprises a machine frame 20, two pedal units 30, two handlebars 50, and a flywheel set 60.

The machine frame 20 comprises a base 21, an upright post 22, a front bracket 23, and a casing 24. The upright post 22 has the bottom end thereof connected to the center of the base 21 and the opposing top end thereof provided with a control panel 80. The front bracket 23 is connected between the lower half of the upright post 22 and the front half of the base 21. The casing 24 is placed between the lower half of the upright post 22 and the front half of the base 21. In addition, the opposing left and right sides of the casing 24 respectively have a position-limiting slot 25, and the position-limiting slot 25 is covered by a shutter 26.

The two pedal units 30 are located on the left and right sides of the machine frame 20. Each pedal unit 30 comprises a vertical arm 31, a driving main arm 33, a pedal mount 34, a slanting rod 38, a pedal 40 and a rocking link 42.

Figure 6:
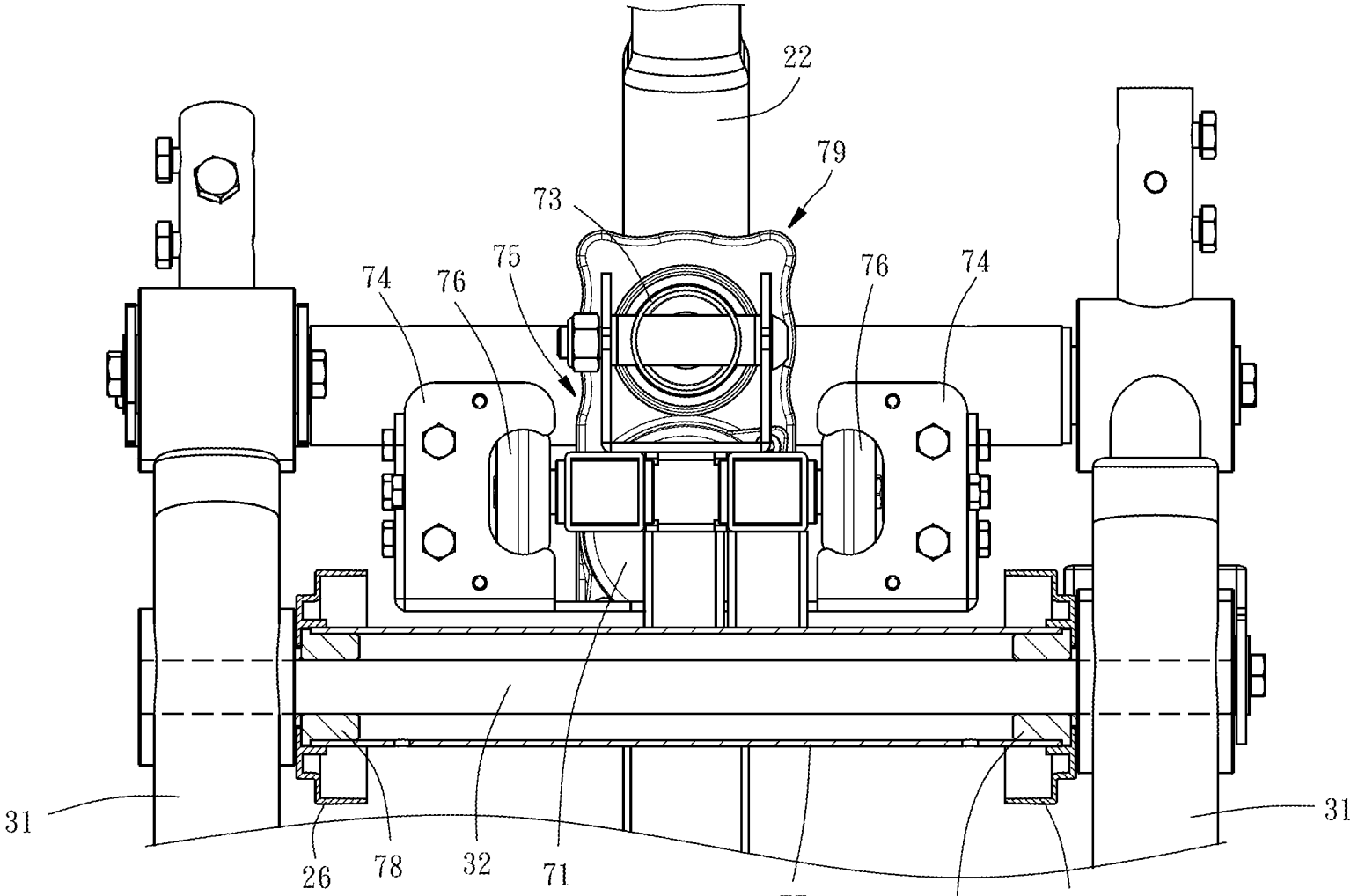
FIG. 6 is a sectional view of a part of the elliptical machine of the present invention, showing the structural relationship between the vertical 1, the slide and the front axle.

As shown in FIG. 6, the top ends of the two vertical arms 31 are pivotally connected to a front axle 32, so that the two vertical arms 31 can swing back and forth with respect to the machine frame 20. The front axle 32 is located inside the casing 24, and the two opposite ends of the front axle 32 are connected to the left and right shutters 26, so that the front axle 32 can be synchronized with the left and right shutters 26. The front end of the driving main arm 33 is pivotally arranged at the bottom end of the associating vertical arm 31 and movable up and down relative to the associating vertical arm 31.

Figure 4:
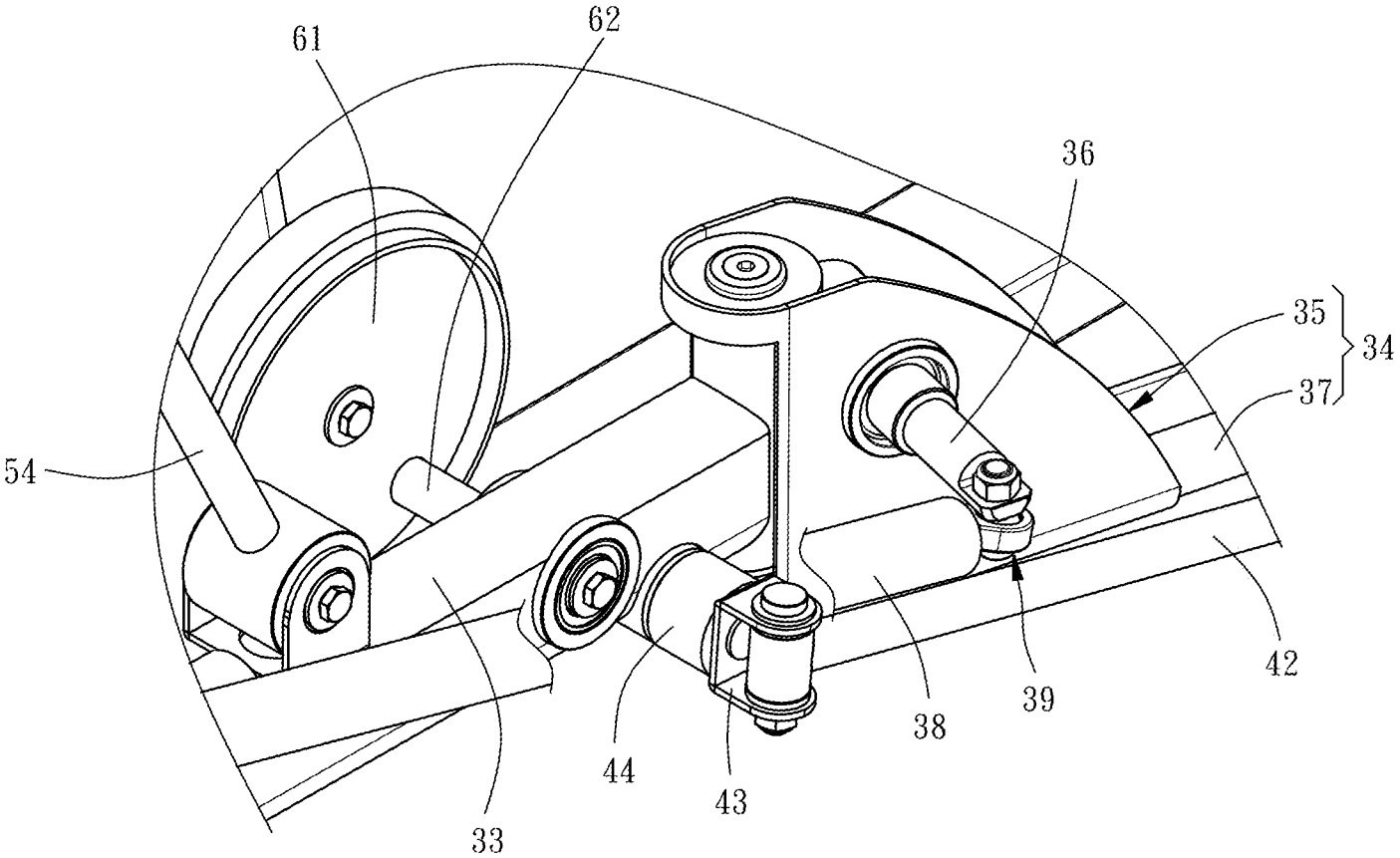
FIG. 4 is an enlarged view of a part of the elliptical machine of the present invention, showing the structural relationship between the driving main arm, the pedal mount and the slanting rod.

The pedal mount 34 comprises a first adapter plate 35 and a support rod 37. As shown in FIG. 4, the first adapter plate 35 is pivotally disposed at the rear end of the driving main arm 33 and movable left and right relative to the driving main arm 33, and the front end of the support rod 37 is fixed to the first adapter plate 35.

Figure 3:
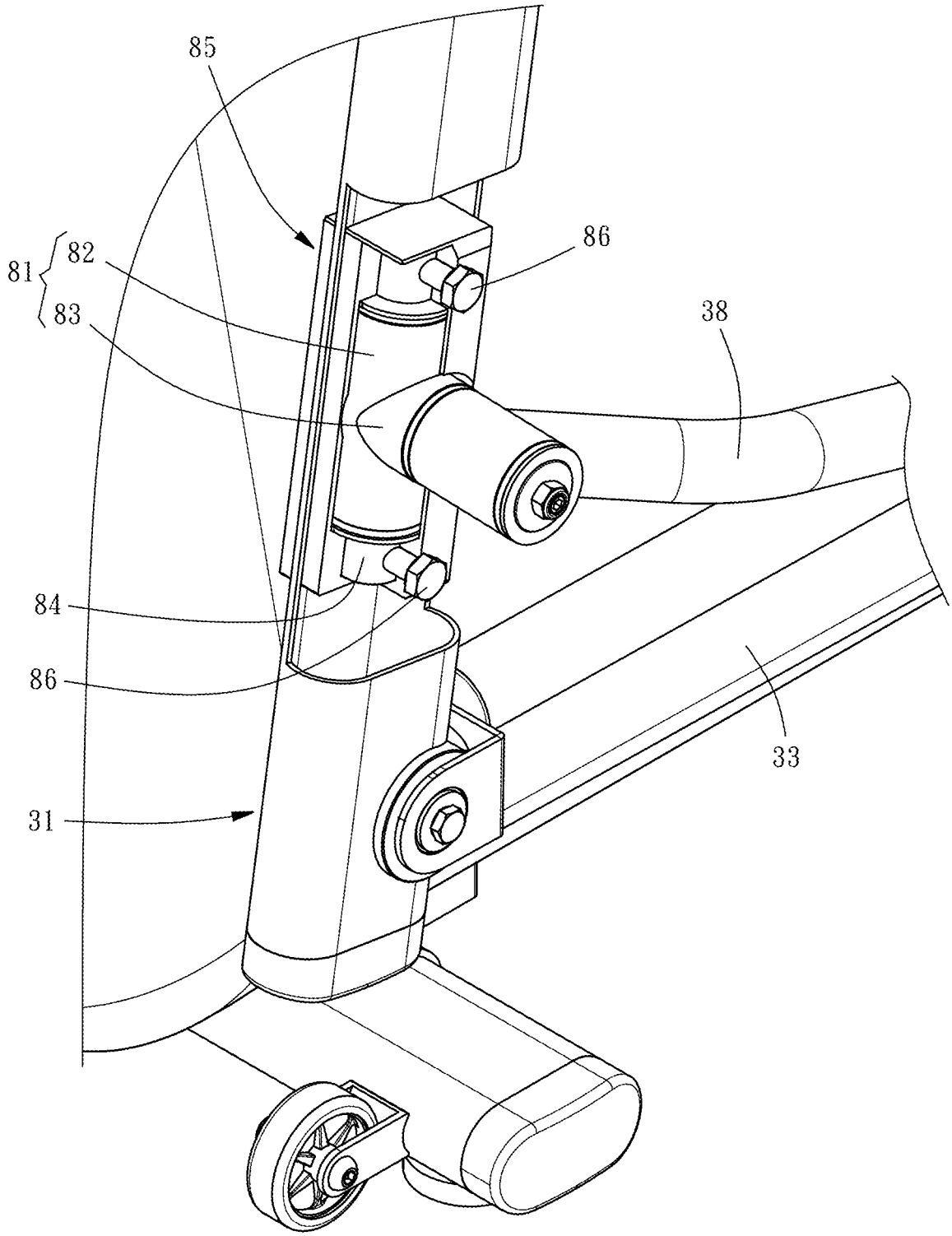
FIG. 3 is a sectional view of a part of the elliptical machine of the present invention, showing the structural relationship between the vertical arm, the slanting rod and the rotating rod.

As shown in FIG. 3, the front end of the slanting rod 38 is pivoted to the vertical arm 31 by a rotating rod 81, so that the front end of the slanting rod 38 is located above the front end of the driving main arm 33 and can swing up and down relative to the vertical arm 31. More specifically, the rotating rod 81 has a first shaft portion 82 and a second shaft portion 83 perpendicularly connecting the first shaft portion 82. The first shaft portion 82 is located in an axle housing 85 and is pivotally mounted to a shaft member 84 in a swingable manner. The shaft member 84 is located in the vertical arm 31 together with the axle housing 85 and is locked with the vertical arm 31 by two upper and lower bolts 86 so that the axial direction of the shaft member 84 is parallel to the length of the vertical arm 31. The second shaft portion 83 of the rotating rod 81 is inserted out of the vertical arm 31, so that the front end of the slanting rod 38 can be pivoted up and down. As shown in FIG. 4, the rear end of the slanting rod 38 is pivoted to one end of a first adapter shaft 36 by a joint bearing 39. The first adapter shaft 36 is pivoted to the first adapter plate 35, and the axial direction of the first adapter shaft 36 is perpendicular to the length of the support rod 37 of the pedal mount 34, so that the slanting rod 38 and the pedal mount 34 can rotate relative to each other.

Figure 5:
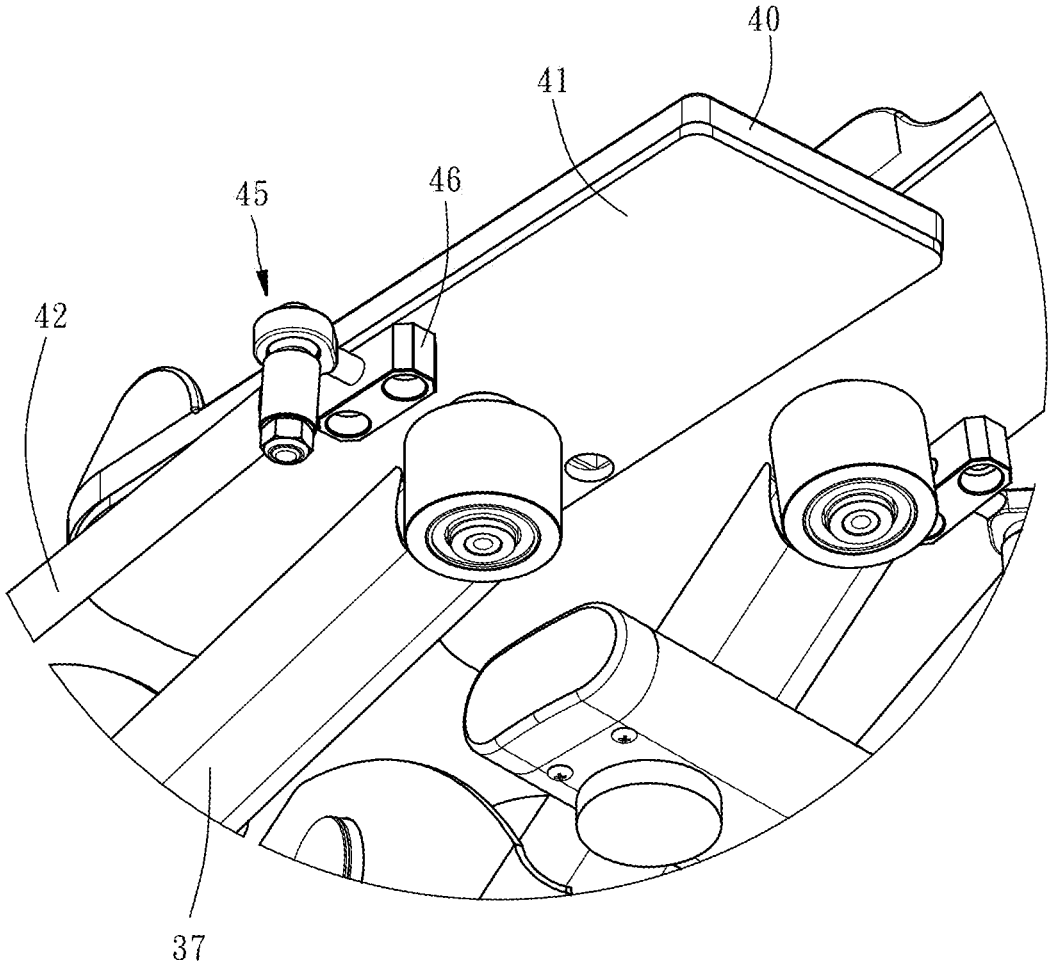
FIG. 5 is an enlarged view of a part of the elliptical machine of the present invention, showing the structural relationship between the pedal mount, the pedal and the slanting rod.

The top surface of the pedal 40 is used to receive the user's sole, and the bottom surface of the pedal 40 is locked with a bottom plate 41 using fastening members such as screws. As shown in FIG. 5, the bottom plate 41 is pivoted to the rear end of the support rod 37 of the pedal mount 34 in a swingable manner.

The front end of the rocking link 42 is pivotally mounted to a second adapter plate 43 and swingable left and right relative to the second adapter plate 43. As shown in FIG. 4, the second adapter plate 43 is pivoted to a second adapter plate 44. The second adapter shaft 44 is disposed on the bottom surface of the driving main arm 33, and the axial direction of the second adapter shaft 44 is perpendicular to the length of the driving main arm 33. The rear end of the rocking link 42 is pivoted to an adapter block 46 by a joint bearing 45. As shown in FIG. 5, the adapter block 46 is fixed on the outer side of the bottom surface of the bottom plate 41 by means of welding or a fixing component such as a screw, so that the rocking link 42 and the pedal 40 can rotate universally relative to each other.

Two handlebars 50 are located on the left and right sides of the machine frame 20. As shown in FIG. 2, each handlebar 50 comprises an upper tube 51 and a lower tube 52. The top end of the upper tube 51 is for grasping by the user's hand. The bottom end of the upper tube 51 and the top end of the lower tube 52 are pivotally connected to a rear axle 54 (see FIG. 7). The rear axle 54 is inserted through and affixed to the upright post 22. The bottom end of the lower tube 52 is pivotally disposed at the top end of a hanging tube 53 and swingable back and forth, and the bottom end of the hanging tube 53 is pivotally disposed on the top surface of the driving main arm 33 and swingable back and forth. In this way, the two handlebars 50 can swing back and forth along with the two driving main arms 33.

Figure 7:
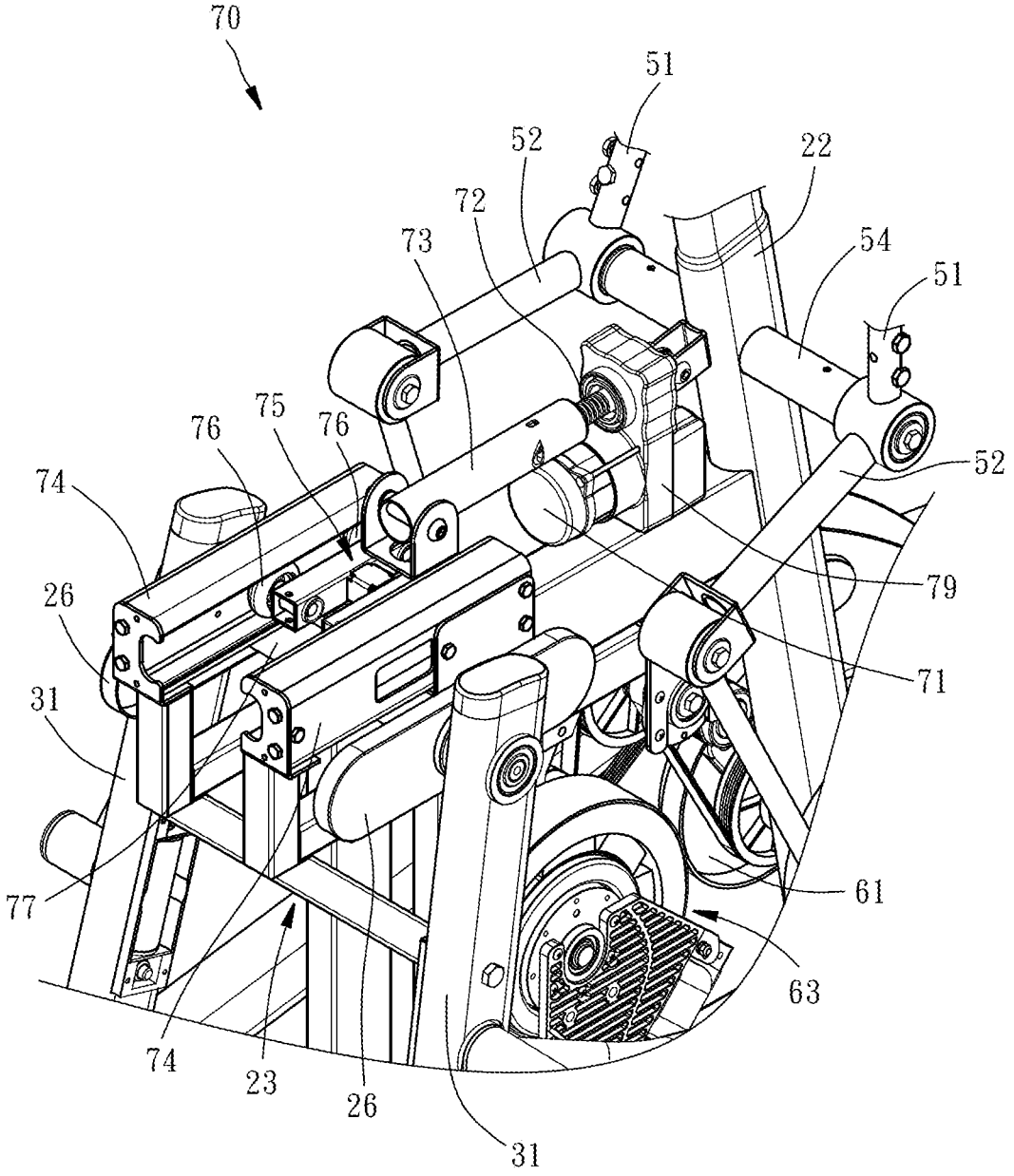
FIG. 7 is an elevational view of the step length adjustment unit of the elliptical machine of the present invention, showing the slide located at the rear end of the guide rails.

The flywheel set 60 comprises two flywheels 61 and two crankshafts 62. As shown in FIG. 4, the two flywheels 61 are pivotally mounted on the left and right sides of the upright post 22 of the machine frame 20 in a rotatable manner. The two crankshafts 62 have the respective one ends thereof respectively connected to the two flywheels 61, and the respective other ends thereof respectively connected to the inner side of the two driving main arms 33 so that the two crankshafts 62 can be driven by the two driving main arms 33 to rotate the two flywheels 61. In addition, the resistance generated during operation of the left and right flywheels 61 is provided by an electromagnetic resistance unit 63. As shown in FIG. 7, the electromagnetic resistance unit 63 is connected to the left and right flywheels 61 by means of a transmission element such as a timing pulley or a timing belt. As long as the electric current through the electromagnetic resistance unit 63 is changed, the resistance provided to the left and right flywheels 61 can be adjusted. Since the electromagnetic resistance unit 63 is a well-known technology and is not the focus of the present invention, in order to save space, the detailed structure and operation principle will not be described here.

In another aspect, the present invention further provides a step length adjustment unit 70. As shown in FIG. 6 and FIG. 7, the step length adjustment unit 70 comprises a motor 71, a lead screw 72, an internally-threaded tube 73, two guide rails 74, and a slide 75.

The motor 71 can be pivoted up and down on the front side of the upright post 22 of the machine frame 20.

The axial direction of the lead screw 72 is parallel to the extending direction of the left and right position-limiting slots 25 of the casing 24. One end of the lead screw 72 is connected to the motor 71 through a reducer 79, so that the lead screw 72 can be rotated by the motor 71.

The internally-threaded tube 73 is threaded onto the lead screw 72 so that the internally-threaded tube 73 can be driven by the lead screw 72 to move forward or backward along the axial direction of the lead screw 72.

The two guide rails 74 are disposed opposite each other on the front bracket 23 of the machine frame 20.

The top of the slide 75 is locked to the front end of the internally-threaded tube 73 with a fixing element such as a bolt, so that the slide 75 can move back and forth along with the internally-threaded tube 73. Each of the left and right sides of the slide 75 is provided with a pair of guide wheels 76, and the slide 75 is provided on the two guide rails 74 by the two pairs guide wheels 76 to increase the stability and smoothness during the operation. In addition, as shown in FIG. 6, the bottom of the slide 75 has a transmission tube 77 and two end caps 78. The transmission tube 77 is coaxially sleeved over the front axle 32 and maintained at a predetermined interval from the front axle 32. The left and right ends of the transmission tube 77 are respectively inserted into the two shutters 26, so that the transmission tube 77 can drive the two shutters 26 to move back and forth together. The two end caps 78 are disposed in the left and right ends of the transmission tube 77 and are tightly disposed on the left and right ends of the front axle 32.

In this way, the slide 75 can drive the left and right vertical arms 31 to move back and forth with the intermediate-threaded tube 73 through the front axle 32.

Figure 8:
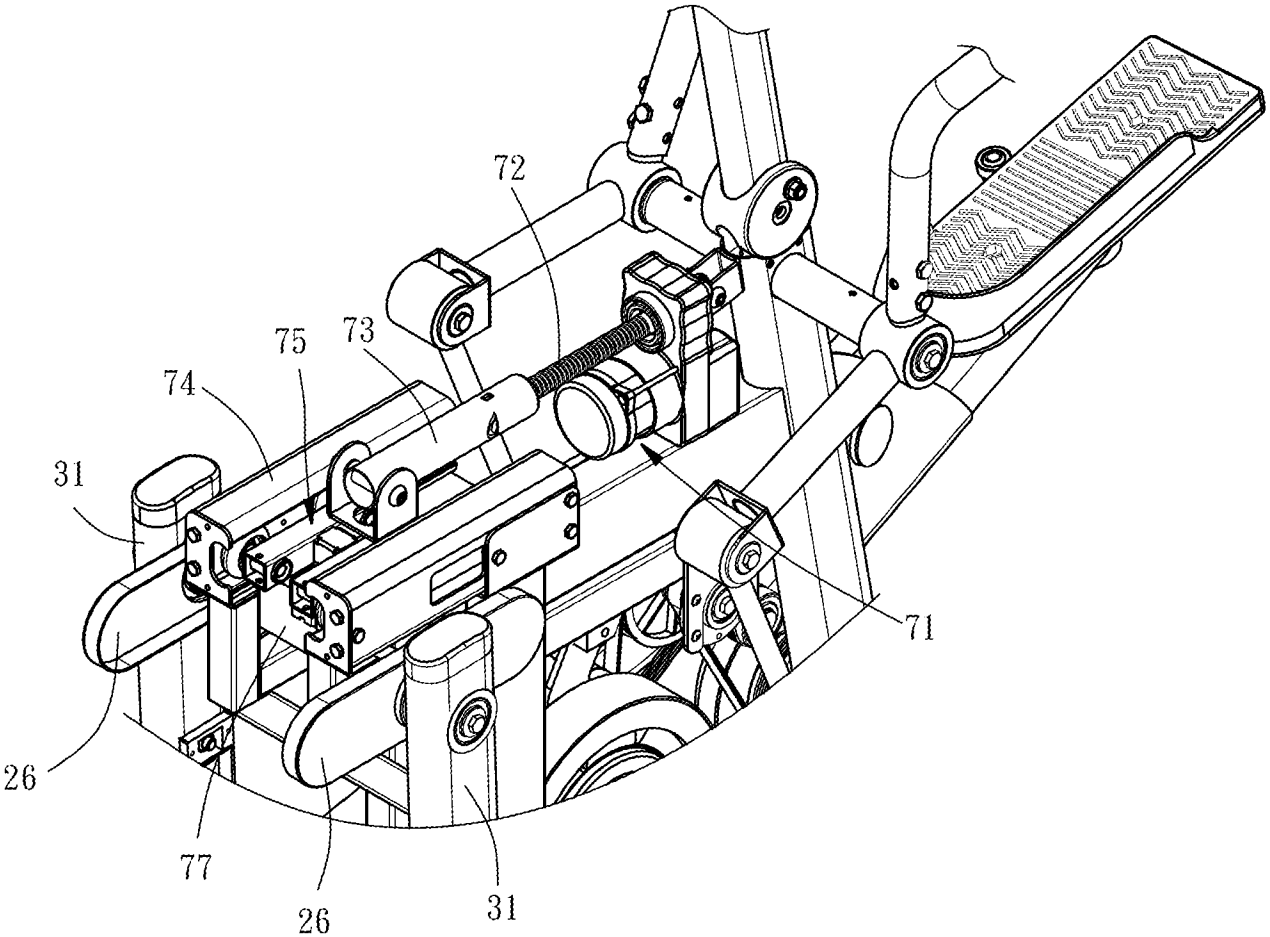
FIG. 8 is similar to FIG. 7, showing the slide located at the front end of the guide rails.
Figure 9:
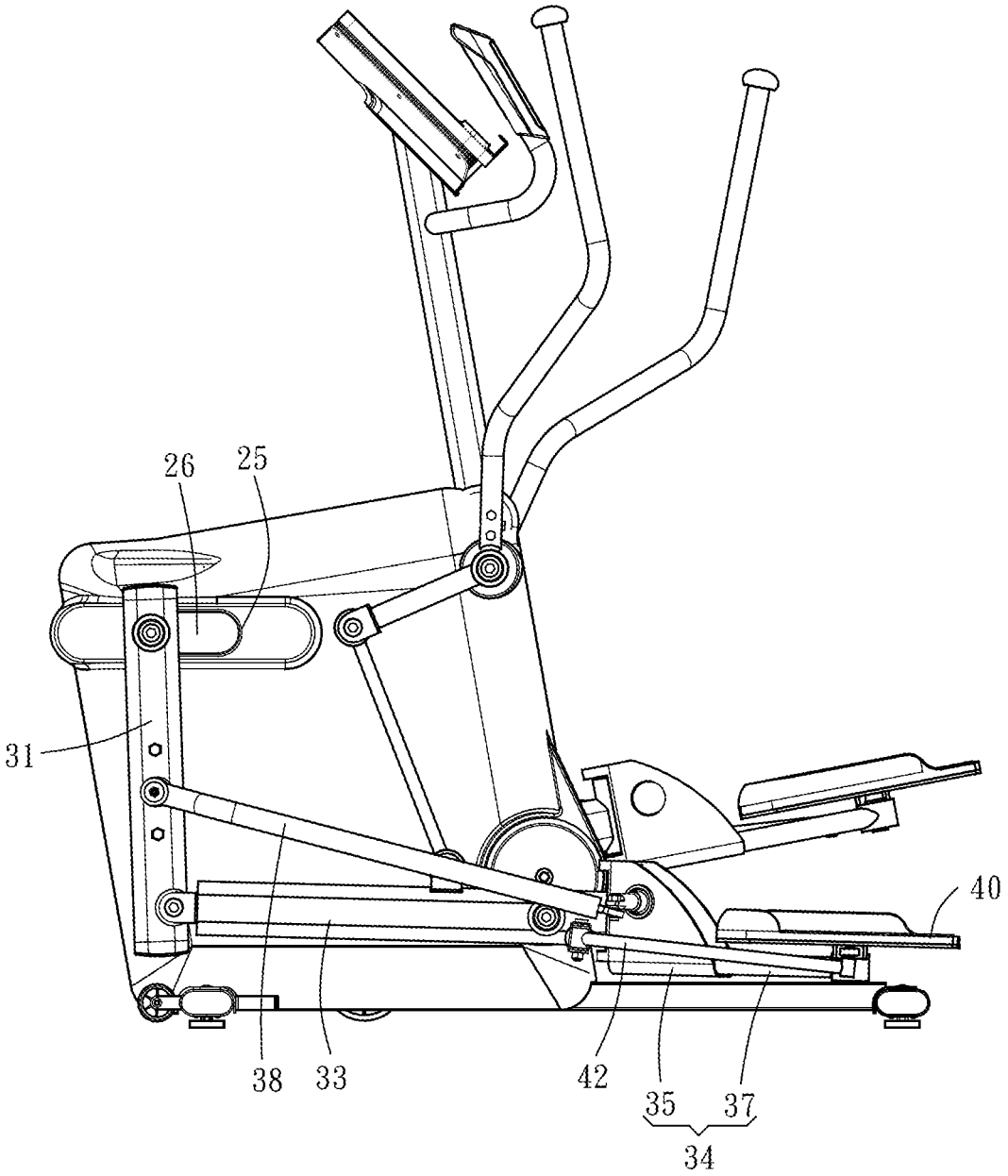
FIG. 9 is similar to FIG. 2, showing the pedal units of the elliptical machine in the long step length mode.
Figure 10:
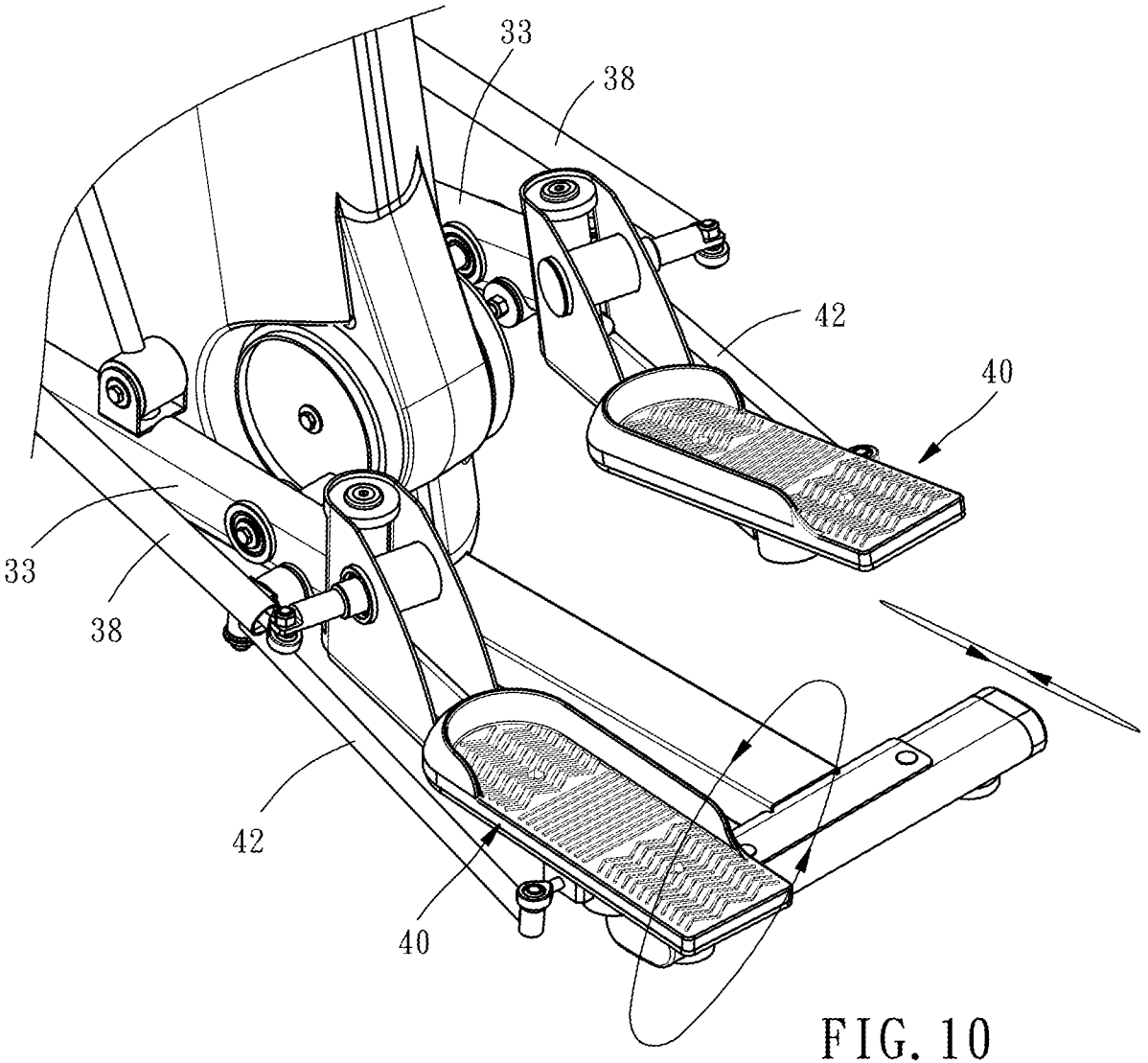
FIG. 10 is an enlarged view of a part of the elliptical machine of the present invention, mainly showing the motion trajectory of the pedals in the short step length mode.
Figure 11:
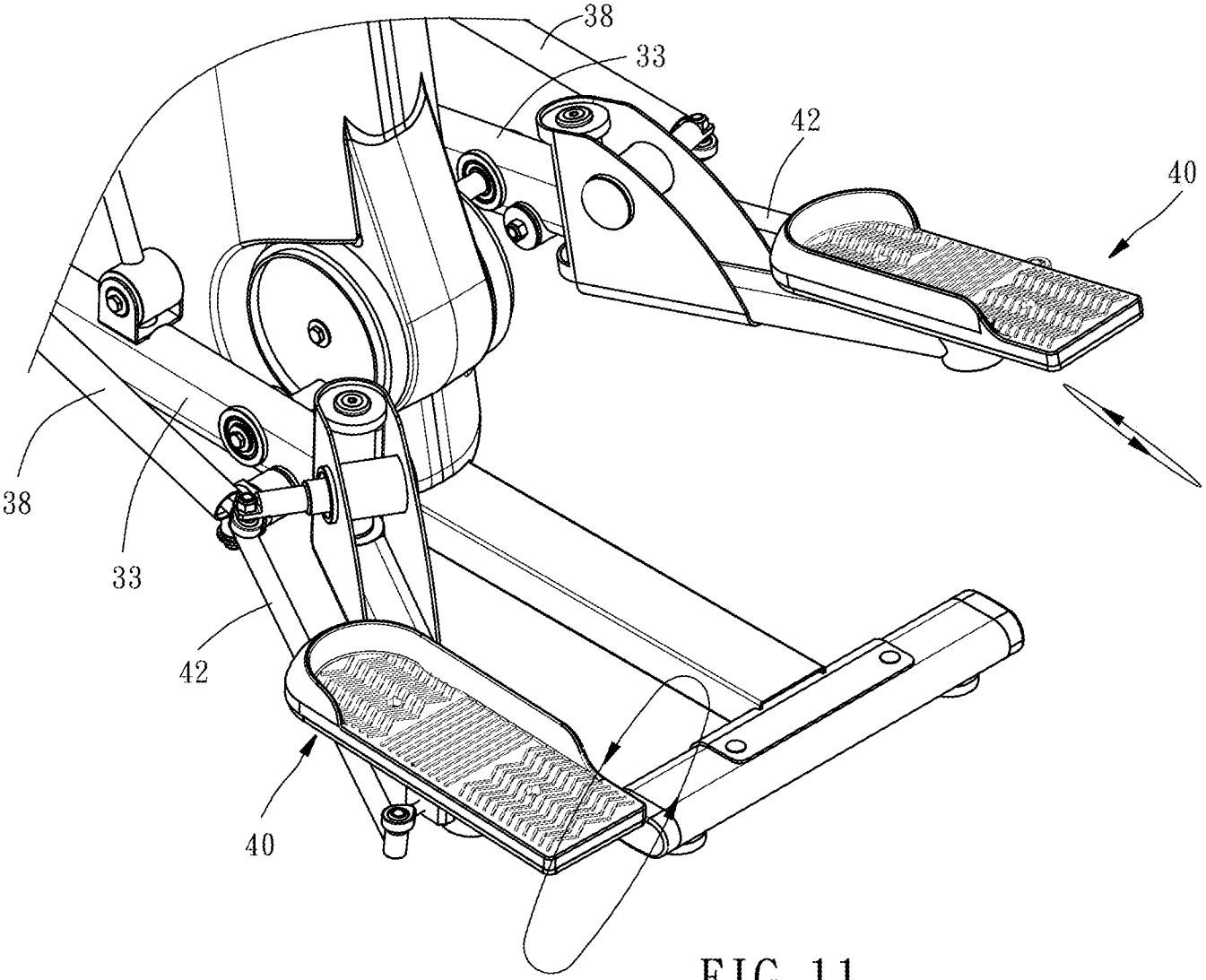
FIG. 11 is similar to FIG. 10, mainly showing the motion trajectory of the pedals in the long step length mode.

Once the front and rear positions of the vertical arms 31 have changed, you can change the driving angle of driving main arms 33, slanting rods 38, pedal mounts 34, pedals 40 and rocking links 42 to achieve the effect of adjusting the step length. Further, as shown in FIG. 6, when the slide 75 is located at the rear end of the two guide rails 74, the left and right vertical arms 31 will be located with the front axle 32 at the rear end of the left and right position-limiting slots 25 (see FIG. 2). At this time, the pedal units 30 are in the short step length mode, and the movement trajectory presented by the user when stepping on the left and right pedals 40 is the direction of the arrow shown in FIG. 10. Conversely, as shown in FIG. 8, when the slide 75 is pushed to the front end of the two guide rails 74 by the essentially-threaded tube 73, the left and right vertical arms 31 will move along with the front axle 32 to the front end of the left and right position-limiting slots 25 (as shown in FIG. 9). At this time, the pedal units 30 are in the long step length mode, and the movement trajectory presented by the user when stepping on the left and right pedals 40 is the direction of the arrow shown in FIG. 11. The above two different step length modes can be switched on the control panel 80, which is quite convenient in operation.

Figure 12:
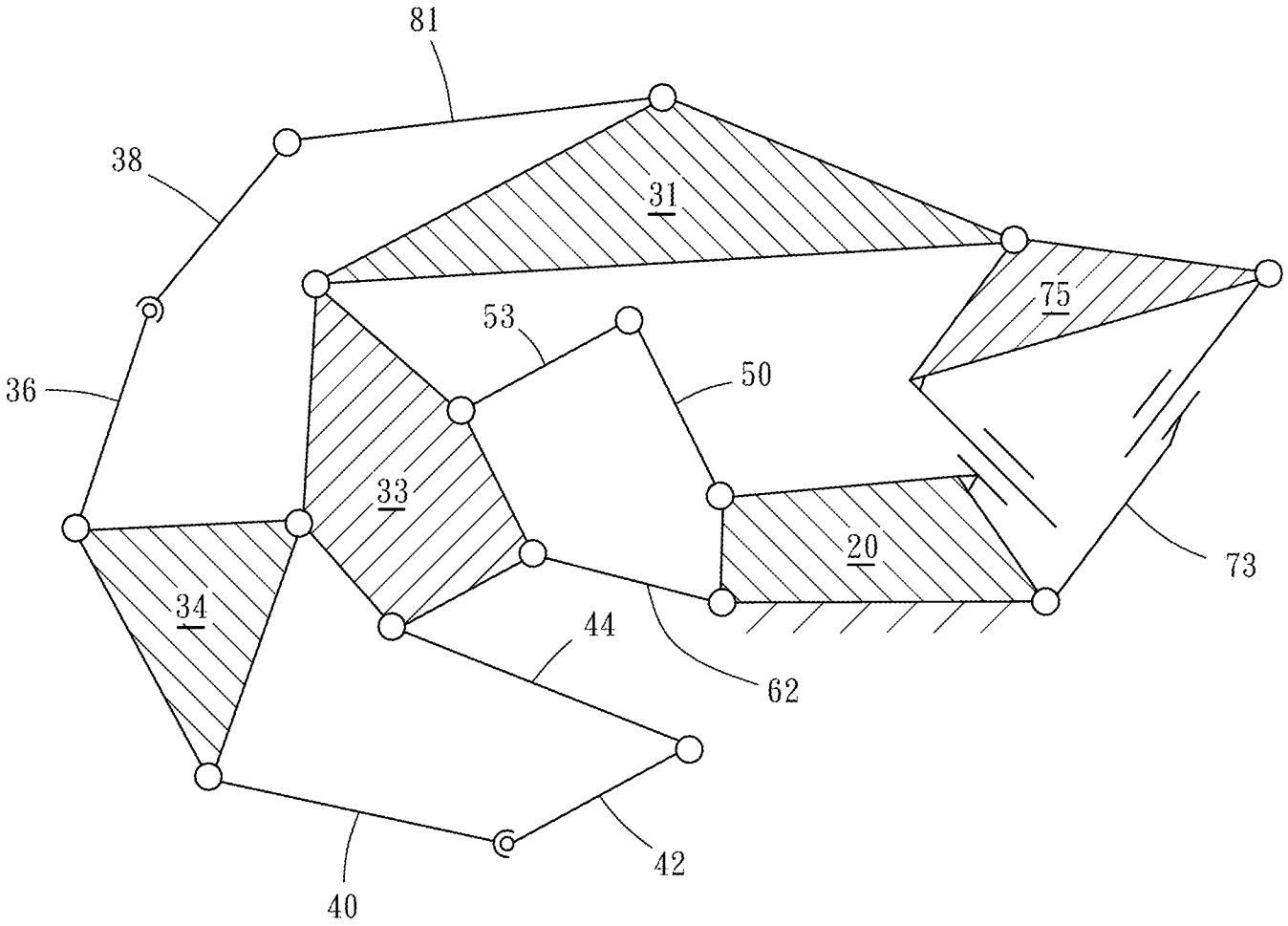
FIG. 12 is a schematic drawing showing the linking of the pedal unit of the elliptical machine of the present invention.

However, no matter which step length mode is switched to, when the user steps on the left and right pedals 40, subject to the multi-link design of the pedal units 30 (as shown in FIG. 12) and the two universal joints on the left and right sides, the left pedal 40 will move along the elliptical trajectory from the upper right to the lower left, while the right pedal 40 moves from the upper left to the lower right along the elliptical trajectory. In this way, the whole stepping process will show a three-dimensional motion mode of swinging left and right. Compared with the traditional elliptical machines, the leg muscles of different parts can be trained, and the whole pedaling process is more interesting and challenging, thereby implementing three-dimensional pedaling training effect.

What is claimed is:

1. An elliptical machine, comprising:

a machine frame;

two pedal units located on opposing left and right sides, each said pedal unit comprising a vertical arm, a driving main arm, a pedal mount, a slanting rod, a pedal and a rocking link, said vertical arm having a top end thereof pivotally connected to said machine frame and swingable back and forth relative to said machine frame, said driving main arm having a front end thereof pivotally connected to a bottom side of said vertical arm and swingable up and down relative to said machine frame, said pedal mount having a front end thereof pivotally connected to an opposing rear end of said driving main arm and swingable left and right relative to said driving main arm, said pedal being pivoted to an opposing rear end of said pedal mount and swingable left and right relative to said pedal mount, said slanting rod having a front end thereof pivotally connected to said vertical arm in a vertically swingable manner and located above the front end of said driving main arm and an opposing rear end thereof pivotally connected to the front end of said pedal mount in a universally rotatable manner, said rocking link having a front end thereof pivotally connected to the opposing rear end of said driving main arm and swingable back and forth and up and down relative to said driving main arm and an opposing rear end thereof pivotally connected to said pedal in a universally rotatable manner;

two handlebars located on opposing left and right sides of said machine frame, said two handlebars each having a bottom end thereof respectively pivotally connected to a center of the respective driving main arms and swingable back and forth relative to the respective driving main arms; and a flywheel set comprising two flywheels and two crankshafts, said two flywheels being respectively pivotally mounted on the left and right sides of said machine frame in a rotatable manner, said two crankshafts having respective one ends thereof respectively connected to said two flywheels and respective opposite ends thereof respectively connected to said driving main arms so that said two crankshafts are drivable by said driving main arms to rotate said two flywheels; and a step length adjustment unit, said step length adjustment unit comprising a motor, a lead screw, an internally-threaded tube and a slide, said motor being pivotally connected to said machine frame in a vertically swingable manner, said lead screw having one end thereof connected to said motor, said internally-threaded tube being threaded onto said lead screw and drivable by said lead screw to move along an axial direction of said lead screw, said slide being connected to said internally-threaded tube and the top ends of the two said vertical arms of said two pedal units so that said slide is drivable by said internally-threaded tube to move the two said vertical arms of said two pedal units;

wherein said step length adjustment unit further comprises two guide rails respectively disposed on opposing left and right sides of the two pedal units; said slide comprises two guide wheels respectively disposed on opposing left and right sides thereof and respectively rotatably mounted in said guide rails.

2. The elliptical machine as claimed in claim 1, wherein said pedal mount of each said pedal unit further comprises a first adapter plate and a support rod, said first adapter plate being pivotally connected to the rear end of the associating said driving main arm and swingable left and right relative to the associating said driving main arm, said support rod having a front end thereof affixed to said first adapter plate; said slanting rod of each said pedal unit has the rear end thereof pivotally connected to one end of a first adapter shaft in a universally rotatable manner, said first adapter shaft being pivotally connected to said first adapter plate, an axial direction of said first adapter shaft being perpendicular to a length of said support rod; said pedal of each said pedal unit is pivotally connected to an opposing rear end of the associating said support rod and swingable left and right relative to the associating said support rod.

3. The elliptical machine as claimed in claim 2, wherein said pedal of each said pedal unit has a bottom side thereof fixedly mounted with a bottom plate, said bottom plate being pivotally connected to the rear end of the associating said support rod and swingable left and right relative to the associating said support rod.

4. The elliptical machine as claimed in claim 3, wherein said bottom plate has an outer side of a bottom surface thereof locked with an adapter block; said pedal of each said pedal unit is pivotally connected to the rear end of the associating said rocking link through said adapter block in a universally rotatable manner.

5. The elliptical machine as claimed in claim 1, wherein said machine frame comprises a casing, said casing covering said step length adjustment unit and comprising two position-limiting slots respectively located on opposing left and right sides thereof, each said position-limiting slot being covered by a respective shutter, an extending direction of each said position-limiting slot being parallel to an axial direction of said lead screw; the top ends of said two vertical arms are pivotally connected to a front axle, said front axle being located inside said casing and having two opposite ends thereof respectively connected to the respective shutters; said slide comprises a transmission tube and two end caps, said transmission tube being coaxially sleeved over said front axle and maintained at a predetermined interval from said front axle, said two end caps being respectively disposed in two opposite ends of said transmission tube and tightly disposed on said front axle so that said slide is capable of carrying said two vertical arms to move with said internally-threaded tube.

6. The elliptical machine as claimed in claim 1, wherein each said handlebar comprises an upper tube and a lower tube, said upper tube having a bottom end thereof pivotally connected with a top end of said lower tube to said machine frame in a forward-backward swingable manner, said lower tube having an opposing bottom end thereof pivotally connected to a top end of a hanging tube in a forward-backward swingable manner, said hanging tube having an opposing bottom end thereof pivotally connected to a top end of one said driving main arm in a forward-backward swingable manner.

7. The elliptical machine as claimed in claim 1, wherein the front end of said rocking link of each said pedal unit is pivotally connected to a second adapter plate and swingable left and right relative to said second adapter plate, said second adapter plate being pivotally connected to one end of a second adapter shaft, said second adapter shaft being affixed to a bottom side of the associating said driving main arm, an axial direction of said second adapter shaft being perpendicular to a length of the associating said driving main arm.

8. The elliptical machine as claimed in claim 1, wherein the front end of said slanting rod of each said pedal unit is pivotally connected to a rotating rod in a vertically swingable manner, said rotating rod being pivotally connected to a shaft member and swingable left and right relative to said shaft member, said shaft member is fixedly mounted in the associating said vertical arm, an axial direction of said shaft member being parallel to a length of the associating said vertical arm.

* * * * *